US005527029A

United States Patent [19]

Bortolotti et al.

[11] Patent Number: 5,527,029

[45] Date of Patent: Jun. 18, 1996

[54] DEVICE FOR INTRODUCING SHEETS OR ENVELOPES INTO A PRINTER

[75] Inventors: Giuseppe Bortolotti; Jorge Costa, both of Yverdon-Les-Bains, Switzerland

[73] Assignee: OCD S.A., Yverdon-Les-Bains, Switzerland

[21] Appl. No.: 352,153

[22] Filed: Dec. 1, 1994

[30] Foreign Application Priority Data

Mar. 7, 1994 [CH] Switzerland ..... 682/94

[51] Int. Cl.[6] ..... B65H 3/52

[52] U.S. Cl. ..... 271/124; 271/121; 271/167

[58] Field of Search ..... 271/121, 124, 271/126, 127, 160, 167

[56] References Cited

U.S. PATENT DOCUMENTS

| | | | |
|---|---|---|---|
| 5,026,042 | 6/1991 | Miller | 271/121 |
| 5,277,417 | 1/1994 | Moritake | 271/121 |

FOREIGN PATENT DOCUMENTS

| | | | |
|---|---|---|---|
| 0386737 | 9/1990 | European Pat. Off. . | |
| 0562812 | 9/1993 | European Pat. Off. | 271/121 |
| 2564445 | 11/1985 | France . | |
| 3838038 | 5/1989 | Germany . | |
| 58-47739 | 3/1983 | Japan . | |
| 1-172140 | 7/1989 | Japan | 271/121 |
| 4-94339 | 3/1992 | Japan | 271/121 |
| 4-94341 | 3/1992 | Japan | 271/121 |

*Primary Examiner*—H. Grant Skaggs
*Attorney, Agent, or Firm*—Young & Thompson

[57] ABSTRACT

The introduction device includes a supply tray (6) with a front wall (9), in which a pile of sheets (14) is biased towards driving rollers (17) by the action of a support plate (12) and a spring (16). The front wall (9) is provided with an extension (30) of which one portion forms a fixed sloping plane (31) provided with three openings (34). Three leaf springs (35) are fastened on one side of the supply tray and have at their other end a curved part (36)engaged into the openings (34). These springs (35) form with the sloping plane (31) a retaining member (40) of which the slope is variable depending on the rigidity of the sheets or envelopes to be introduced, the slope being small in the case of thin sheets and greater in the case of rigid sheets or envelopes, thus ensuring a sheet by sheet introduction which is reliable.

9 Claims, 5 Drawing Sheets

DEVICE FOR INTRODUCING SHEETS OR ENVELOPES INTO A PRINTER

FIELD OF THE INVENTION

The invention is concerned with a device for introducing flat items to be printed, such as paper sheets and/or envelopes, into printers or typewriters, including a substantially flat bottomed supply tray into which is placed a pile of said flat items and from which these items are extracted one by one and introduced into the printer, with driving rollers being arranged on a driving shaft so as to move the upper flat item of the pile to feed it into the printer or the typewriter, and the device further including at least one retaining member designed for retaining the flat items arranged in said pile beneath the upper flat item.

BACKGROUND OF THE INVENTION

Such devices for introducing sheets of paper are already known for use in printers, typewriters or other apparatuses such as photocopying machines. As retaining member, these devices use very often retaining corners, from under which the upper sheet is extracted when being fed. Though these retaining corners may prove satisfactory for use with sheets which are relatively thin and which are not rigid, it is not possible to use envelopes or sheets which are thicker and more rigid with this type of retaining members.

SUMMARY OF THE INVENTION

The present invention is aimed at obviating this drawback and at providing a device which enables the introduction of flat items to be printed, of widely differing rigidity ranging from very thin paper sheets to cardboard sheets or envelopes.

To this end, the invention is characterized in that the retaining member includes at least one movable part mounted movably on the supply tray and exhibiting an upper surface designed for coming into contact with the front edge of said flat items, for providing a bearing surface having a variable orientation for said flat items arranged downstream of the driving rollers, the orientation of this variable bearing surface with respect to said substantially flat bottom being adjusted according to the rigidity of said items to be printed, and the angle between this variable bearing surface and a plane parallel to said bottom being greater for low rigidity items and smaller for those which are rigid.

In this manner, the retaining member is automatically adapted or can be adjusted manually to the rigidity of the sheets or envelopes which are to be introduced.

In the case of the retaining part being fixed and the angle being too small (i. e. of the slope of this part being too steep), the underlying sheets would not be retained effectively, and they would then be partly dragged along by the upper sheet, should these sheets be thin and of a low rigidity; conversely, rigid sheets or envelopes would not be extracted in the case of a fixed retaining part, should its angle with respect to the support be too large. In the present invention, the retaining member is movable and hence provides a bearing surface with a variable orientation, which makes possible the introduction of items having a rigidity and a thickness which can vary considerably.

In a preferred embodiment, the retaining member further includes a fixed sloping plane forming a predetermined angle with a plane parallel to said bottom, the moving parts being biased resiliently towards a neutral position, in which their variable bearing surface forms an angle with a plane parallel to said bottom higher than said predetermined angle of the fixed sloping plane, the movable parts being oriented by the flat item during its introduction, so that the angle of the variable bearing surface with the plane parallel to said bottom decreases as the rigidity of the flat item to be supplied increases.

Owing to this arrangement, an automatic control is achieved of the orientation of the bearing surface according to the rigidity of the item to be introduced, without the operator having to carry out any adjustment whatsoever.

Advantageously, tile device includes at least two movable parts in the form of leaf springs attached by one of their ends to the supply tray.

This arrangement provides a construction which is simple, reliable and cheap.

BRIEF DESCRIPTION OF THE DRAWINGS

Other advantages will become apparent from the characteristic features set forth in the depending claims and from the more detailed description of the invention made hereafter with reference to drawings illustrating schematically and by way of example an embodiment and alternate versions thereof.

DETAILED DESCRIPTION OF THE INVENTION

Figure 1:
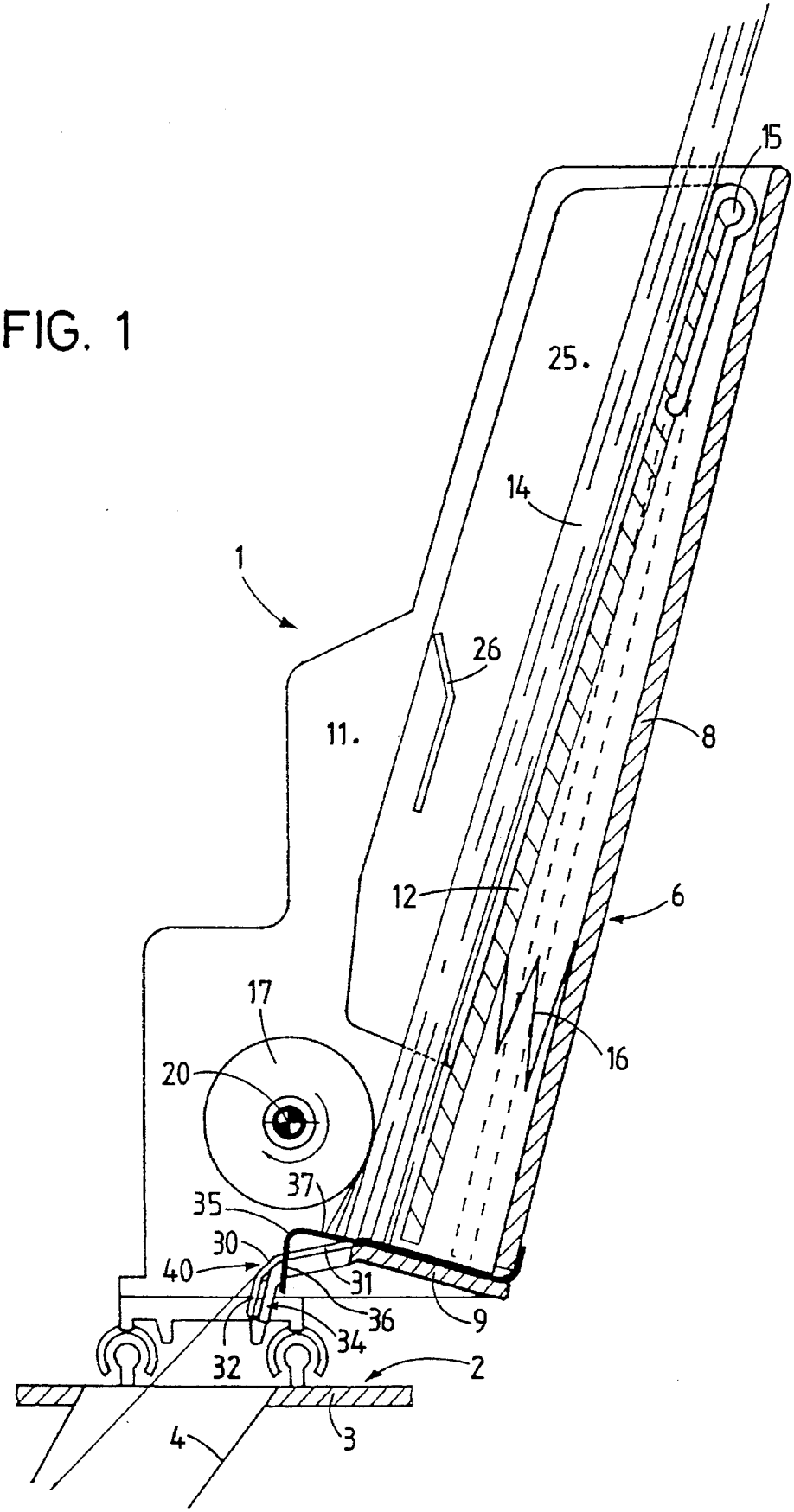
FIG. 1 is a cross-sectional view taken transversally of the device in the neutral position.

The introduction device 1 illustrated in FIGS. 1 to 4 is mounted removably on a printer 2, of which only a part of the frame 3 and of the introduction channel 4 are represented. Of course, the device 1 can also be made integral with the printer, the typewriter or any other apparatus using flat sheets, such as paper sheets, cardboard sheets or envelopes. Device 1 includes a supply tray 6 with a bottom 8, a front wall 9, two fixed side walls 10 and 11 and a support plate 12 on which a pile of sheets 14, of envelopes or of other flat items can be placed.

A support plate 12 is pivotally linked to the side walls 10, 11 by means of two pivots 15 and is biased by a spring 16 in the direction of the driving rollers 17, 18 mounted on a driving shaft 20. The latter is connected via a train of gears 21 to a motor 22. The supply tray 6 further includes a movable side guide 25 mounted slidably along a lateral direction on the upper part of the support plate 12, in order to adapt the width of the introduction device to varying sheet or envelope formats. The lateral movable guide 25 and the side wall 10 are both provided with guiding members 26, 27 defining an introduction channel for the sheets, which facilitates the introduction of a pile 14 of sheets of paper into the supply tray 6.

Figure 4A:
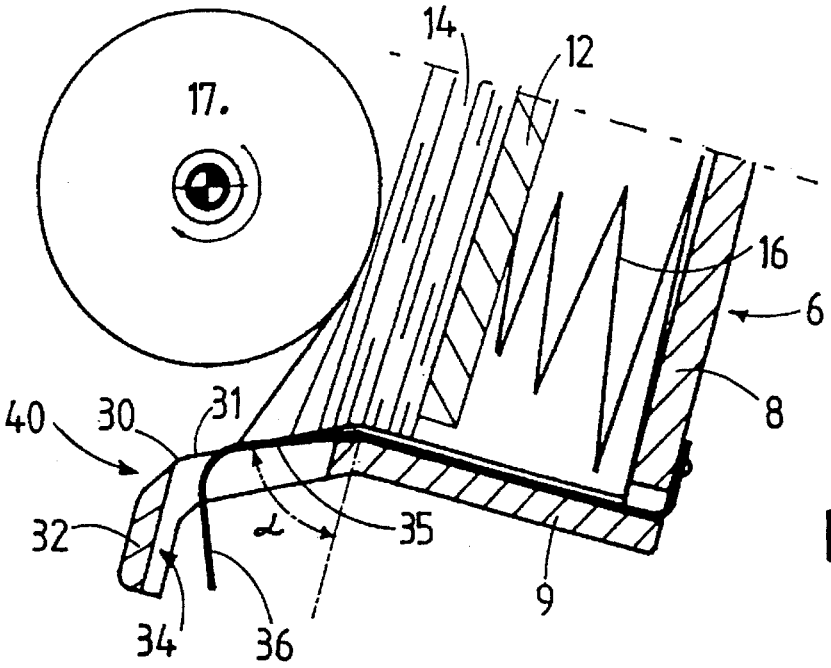
FIGS. 4*a* and 4*b* are partial cross-sectional views taken transversally of the device during the introduction, respectively of a rigid sheet and of a low rigidity sheet.
Figure 4B:
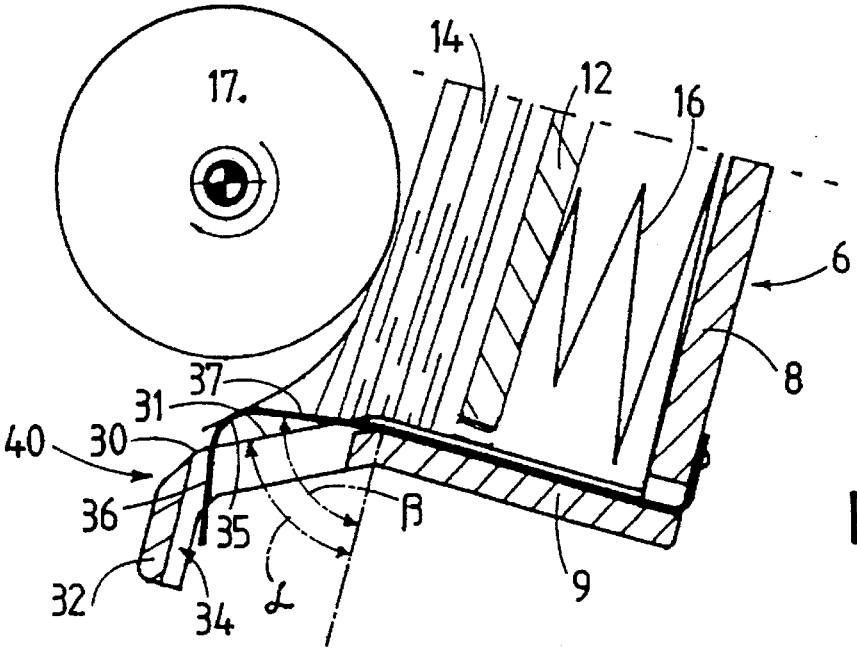

With reference to FIGS. 1, 4*a* and 4*b*, the front wall 9 of the supply tray forms an extension 30 including a first portion 31 providing a fixed sloping plane forming a predetermined angle $\alpha$ with a plane parallel to the bottom 8 of the supply tray and a second curved end portion 32 substantially parallel to said bottom 8. This extension 30 further includes three openings 34 and three leaf springs 35 bent at their free ends 36. These leaf springs 35 are arranged along the front wall 9 and are fastened to the bottom 8 of the supply tray 6. Their free curved ends 36 extend inside the openings 34.

In the neutral position, such as illustrated in FIG. 1 and in FIG. 4B, the non-curved portion 37 of the leaf springs 35 forms an angle β greater than the angle α formed with a plane parallel to the bottom 8. The three leaf springs 35 in combination with the fixed sloping plane 31 thus form a retaining member 40 located downstream of the driving rollers 17. The upper surface of the non-curved part 37 of the leaf springs 35 acts as a bearing surface with a variable orientation for the sheets or envelopes. The angle β between this bearing surface and a plane parallel to the bottom 8 of the supply tray varies according to the rigidity of the items being introduced. This angle β is greater for thin low rigidity sheets and increases in this case to a value close to 90° (see FIG. 4B). Conversely, in the case of rigid sheets, such as cardboard sheets or envelopes, the leaf springs 35 acting as a bearing surface are strongly pushed downwards in FIG. 4*a* by the rigid sheet, so as to provide a slope appropriate for the introduction of the rigid sheet, while retaining the underlaying sheets or envelopes. In this case of rigid items, the angle β becomes equal to the angle α and the rigid sheet extracted slides simultaneously on the fixed sloping plane 31 and on the upper surface of the leaf springs 35 which have retracted into the openings 34.

The angle α between the fixed sloping plane 31 and a plane parallel to the bottom 8 is preferably selected between 30° and 80° and advantageously between 60° and 65° and amounts to 63° in the construction illustrated in FIGS. 1 and 4. The angle of this fixed sloping plane 31 with respect to the front wall 9 hence ranges between 10° and 60° and amounts to 27° in FIGS. 1 and 4.

The variable angle β between the variable bearing surface of the non-curved portion 37 of the leaf springs 35 hence varies essentially between 90° and α, and amounts to 63° in the case of FIGS. 1 and 4.

In the case of the device exhibiting only a fixed sloping plane, one would have to confer to angle α a relatively low value close to 65° so that rigid sheets or envelopes may be extracted; otherwise, these flat rigid items would run the risk of clinging to the fixed sloping plane 31. With such a relatively small angle α, thin low rigidity sheets could not be introduced any more one by one, because the underlying sheets would not be sufficiently retained and would be at least partly dragged along by the upper sheet.

Conversely, with an angle α greater for example than 80°, the thin underlying sheets will be sufficiently retained, but on the other hand the rigid sheets could not be curved sufficiently any more and would therefore remain clinging to the feebly sloping plane. By virtue of the sloping plane with a variable orientation provided for by the leaf springs 35, these drawbacks are eliminated.

Furthermore, owing to the resiliency of the leaf springs 35, the appropriate slope or angle α is automatically adjusted by the flat item being supplied itself, and this according to its rigidity.

Figure 2:
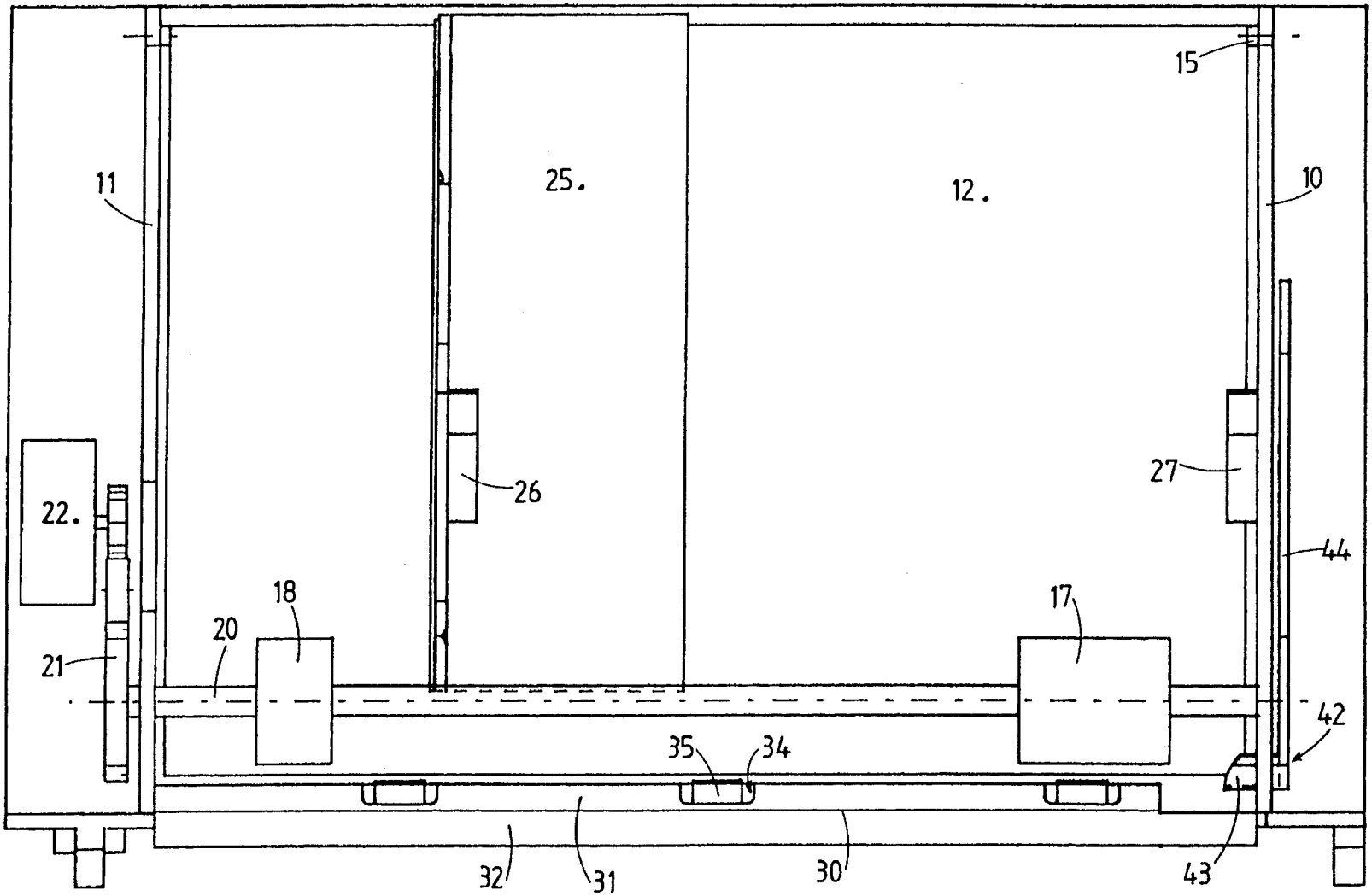
FIG. 2 is a front view of the device.
Figure 3:
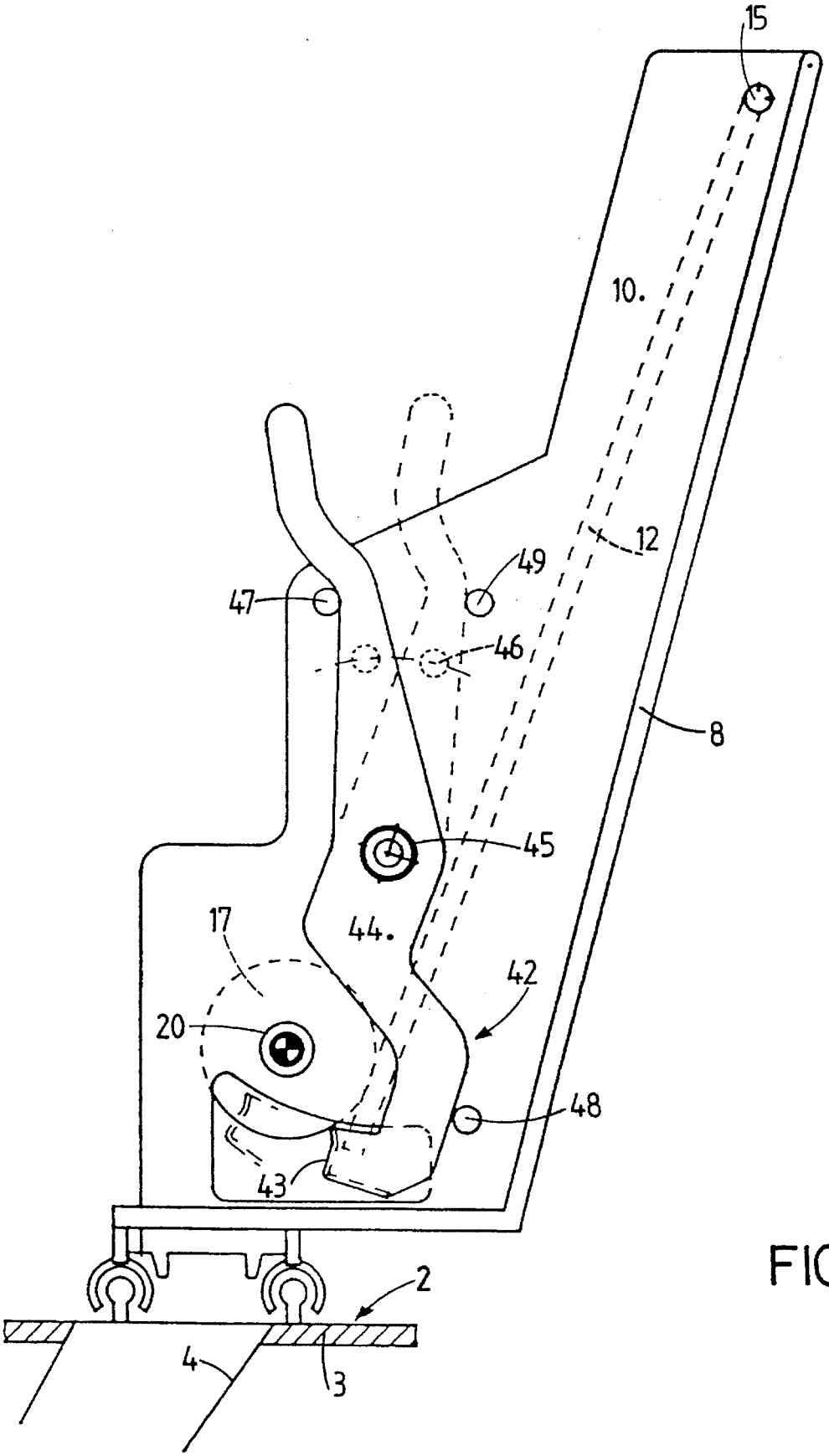
FIG. 3 is a side view thereof.

With reference to FIGS. 2 and 3, the supply device is further provided with an additional retaining member 42. The latter consists of a retaining corner 43 designed for cooperating with one of the corners of the front edge of the sheets. This retaining corner 43 is integral with a lever 44 pivotally linked to the side wall 10, by means of an axis 45. A latching member 46 makes it possible to retain the lever 44 in two positions determined by three stops 47, 48 and 49. In the position illustrated by full lines in FIG. 3, the retaining corner 43 is in the operative position and functions as an additional retaining member for thin low rigidity sheets. In the position represented in phantom in FIG. 3, the retaining corner 43 is retracted. This position is used for items which are rigid or thick, such as envelopes. The device could of course also function satisfactorily without any additional retaining member 42, but the latter acts as an additional safety means making the device particularly reliable even with very fine sheets.

Advantageously, the upper surfaces of the fixed sloping plane 31, of the extension 30 and possibly of the leaf springs 35 can be recovered with a layer of a material modifying the friction coefficient, such as a thin layer of polytetrafluoroethylene. This layer acts more particularly to erase the small irregularities or roughness resulting from the manufacturing of the device.

Figure 5:
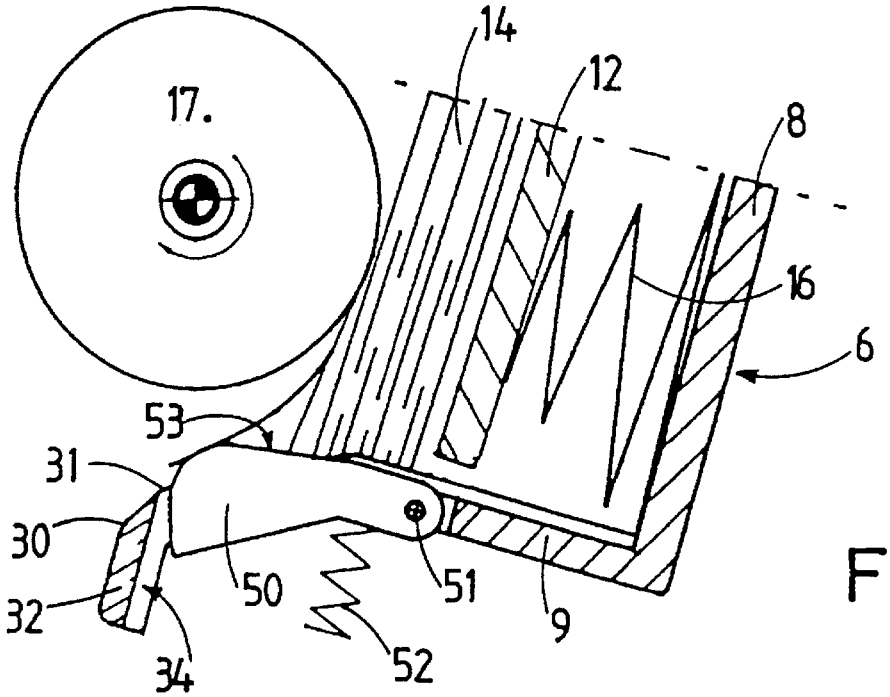
FIGS. 5 and 6 are partial cross-sectional views taken transversally of two alternate versions.

FIG. 5 shows an alternate version of the device in which the leaf springs 35 are replaced by levers 50 mounted pivotally via an axis 51 to the wall 9 of the supply tray 6. Springs 52 push the levers 50 towards a neutral position, such as illustrated in FIG. 5, wherein the upper bearing surface 53 of the lever forms an angle close to 90° with a plane parallel to the bottom 8. This position corresponds to an introduction of sheets of a very low rigidity. Conversely, when rigid envelopes are introduced, lever 50 is rotated in the counterclockwise direction in FIG. 5, so as to be substantially retracted inside the opening 34 in the extension 30. The envelopes then cooperate also with the fixed sloping plane 31.

Figure 6:
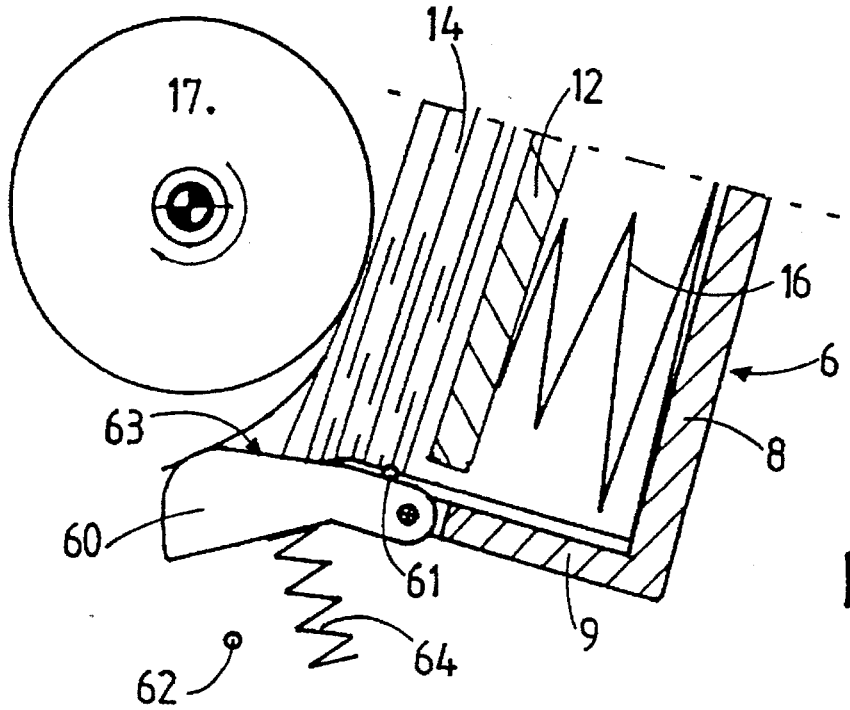

According to an alternate version illustrated in FIG. 6, the retaining member can be provided as a single part 60 forming a lever or a plate, having a width substantially equal to the width of the introduction device, and being mounted pivotally on the front wall 9. The pivoting or tilting motion of this part is restricted in both directions by stops 61, 62, in such a manner that the upper bearing surface of this part 60 having a variable orientation forms an angle β with respect to a plane parallel to the bottom 8, which varies essentially between 90° and 60°. A resilient member 64, such as a spring 64, biases the part towards a neutral position against the stop 61, in which position the angle β is substantially of 90°. The extension 30 of the front wall 9 is deleted in this version.

Of course, the embodiments described above are not of a limiting nature in any way and ran receive any desirable modifications within the scope defined by claim 1. In particular, the position of the supply tray 6 can be different, its bottom 8 can slope or be horizontal. The support plate 12 can be fixed, in which case the driving rollers are biased resiliently against the sheets to be extracted. The number of leaf springs 35 could be other than three, for example four or more. Instead of driving rollers, alternate means could be provided such as a typing cylinder or driving tabs. Instead of the slope of the lever 50 (FIG. 5) or 60 (FIG. 6) being automatically adjusted by means of the springs 52 or 64, these springs can be replaced by a manually or otherwise controlled device, which makes it possible to adjust the upper bearing surface of this lever according to the sheets or envelopes to be introduced. This device could also include an additional retaining member 42 comprising two retractable retaining corners 43.

What is claimed is:

1. A device for introducing flat items to be printed into a printer means, comprising a supply tray having a bottom which is substantially flat, into which a pile of said flat items is placed and from which the items are extracted one-by-one and introduced into the printer means, said supply tray including a front wall which is substantially perpendicular to said bottom, and driving rollers arranged on a driving shaft so as to move an upper flat item of the pile to supply the same to the printer means, the device further including at least one retaining member designed for retaining the flat items arranged in said pile beneath the upper flat item, said retaining member including at least one movable part mounted movably on the supply tray and having an upper surface designed for coming into contact with the front edge of said flat items to provide a bearing surface with a variable orientation for said flat items, positioned downstream of the driving rollers, the orientation of the variable bearing surface with respect to said substantially flat bottom being adjusted according to the rigidity of said flat items to be printed, said retaining member further including a fixed sloping plane extending from the front wall and forming a predetermined angle $\alpha$ with a plane parallel to said bottom, with said at least one movable part being biased resiliently towards a neutral position in which the variable bearing surface forms an angle $\beta$ with a plane parallel to said bottom greater than said predetermined angle $\alpha$ of the fixed sloping plane, said at least one movable part being oriented by the flat item upon its introduction so that the angle $\beta$ of the variable bearing surface with the plane parallel to said bottom decreases with the increasing rigidity of the flat item to be introduced, said predetermined angle $\alpha$ ranging between 30° and 85°, said at least one movable part being mounted on the front wall and the angle $\beta$ between its variable bearing surface and a plane parallel to said bottom being in the neutral position substantially at 90° and varying in an operative position between 90° and 30°.

2. A device according to claim 1, wherein said retaining number includes at least two movable parts in the form of leaf springs fastened by one of their ends to the supply tray.

3. A device according to claim 1, wherein said retaining member includes at least one movable part in the form of a lever mounted pivotally on the supply tray and biased resiliently towards a neutral position in which the angle $\beta$ is greater than the predetermined angle of the fixed sloping plane.

4. A device according to claim 1, wherein the retaining member comprising a resilient member biassing the movable part towards a neutral position, wherein at said neutral position the angle $\beta$ between the variable bearing surface of the movable part and the plane parallel to said bottom is maximum.

5. A device according to claim 1, wherein the upper surface of one of the fixed sloping plane and the moving part is covered with a layer of a substance modifying the friction coefficient.

6. A device for introducing flat items to be printed into a printer means, comprising a supply tray having a bottom which is substantially flat into which a pile of said flat items is placed and from which the items are extracted one by one and introduced into the printer means, driving rollers arranged on a driving shaft so as to move an upper flat item of the pile to supply the same to the printer means, the device further including at least one retaining member designed for retaining the flat items arranged in said pile beneath the upper flat item, said retaining member including at least two movable parts mounted movably on the supply tray and having an upper surface designed for coming into contact with the front edge of said flat items to provide a bearing surface with a variable orientation for said flat items, positioned downstream of the driving rollers, the orientation of the variable bearing surface with respect to said substantially flat bottom being adjusted according to the rigidity of said flat items to be printed, said retaining member further including a fixed sloping plane forming a predetermined angle $\alpha$ with a plane parallel to said bottom, said movable parts being partly engaged into openings of the fixed sloping plane, and being biased resiliently towards a neutral position in which the variable bearing surface forms an angle $\beta$ with a plane parallel to said bottom greater than said predetermined angle $\alpha$ of the fixed sloping plane, said movable parts being oriented by the flat item upon its introduction so that the angle $\beta$ of the variable bearing surface with a plane parallel to said bottom decreases with the increasing rigidity of the flat item to be introduced.

7. A device according to claim 6, wherein said at least two movable parts are in the form of leaf springs fastened by one of their ends to the supply tray.

8. A device according to claim 6, wherein said at least two movable parts are in the form of levers mounted pivotally on the supply tray and biased resiliently towards a neutral position, in which the angle $\beta$ is greater than the predetermined angle $\alpha$ of the fixed sloping plane.

9. A device according to claim 6, wherein the upper surface of one of the fixed sloping plane and the moving parts is covered with a layer of substance modifying the friction coefficient.

* * * * *